United States Patent [19]

Taira

[11] Patent Number: 4,635,600

[45] Date of Patent: Jan. 13, 1987

[54] FUEL INJECTION SYSTEM FOR MULTI-CYLINDER INTERNAL COMBUSTION ENGINES

[75] Inventor: Shigeo Taira, Higashi-matsuyama, Japan

[73] Assignee: Diesel Kiki Co., Ltd., Tokyo, Japan

[21] Appl. No.: 758,551

[22] Filed: Jul. 24, 1985

[30] Foreign Application Priority Data

Jul. 30, 1984 [JP] Japan ..... 59-160058

[51] Int. Cl.[4] ..... F02M 39/00

[52] U.S. Cl. ..... 123/300; 123/299; 123/514; 123/446

[58] Field of Search ..... 123/299, 300, 451, 514, 123/446

[56] References Cited

U.S. PATENT DOCUMENTS

| | | | |
|---|---|---|---|
| 1,195,764 | 8/1916 | Arquembourg | 123/514 |
| 1,365,301 | 11/1921 | Brooks | 123/300 |
| 3,014,466 | 12/1961 | Monnot | 123/299 |
| 3,216,407 | 11/1965 | Eyzat | 123/299 |
| 4,258,681 | 3/1981 | Gruden | 123/514 |
| 4,392,466 | 7/1983 | Mowbray | 123/299 |

FOREIGN PATENT DOCUMENTS

| | | | |
|---|---|---|---|
| 967693 | 11/1950 | France | 123/300 |
| 55-31310 | 8/1980 | Japan | 123/300 |
| 0041657 | 3/1984 | Japan | 123/299 |
| 270747 | 9/1927 | United Kingdom | 123/300 |
| 889560 | 2/1962 | United Kingdom | 123/300 |
| 2126650 | 3/1984 | United Kingdom | 123/300 |

*Primary Examiner*—Carl Stuart Miller

*Attorney, Agent, or Firm*—Frishauf, Holtz, Goodman & Woodward

[57] ABSTRACT

A communication passage connects a first fuel passage connected to a fuel injection valve of a multi-cylinder internal combustion engine corresponding to a cylinder which is to be fired earlier, to a second fuel passage connected to a fuel injection valve corresponding to another cylinder which is to be fired later, at locations in the vicinity of the outlet ports of corresponding delivery valves arranged across the respective fuel passages. A selector valve selectively connects the delivery valve in the first fuel passage with the fuel injection valve corresponding to the first fuel passage or with the communication passage, so that when the engine is operating in a low load and low speed region, part of the cylinder alone is operated and at the same time fuel is allowed to flow in a sole direction from the first fuel passage to the second fuel passage via a one-way valve, to thereby effect a VIGOM injection.

3 Claims, 3 Drawing Figures

FUEL INJECTION SYSTEM FOR MULTI-CYLINDER INTERNAL COMBUSTION ENGINES

BACKGROUND OF THE INVENTION

This invention relates to a fuel injection system for use with a multi-cylinder internal combustion engine.

In diesel engines in general, the rotational speed of the engine tends to become unstable in a low load and low speed region such as an idling region, making it difficult to maintain stable engine operation. This is because in such operating region of the engine, fuel is supplied to the engine in such small quantities that the fuel injection quantity can fluctuate to a large degree, resulting in degraded atomization of the injected fuel.

Further, a diesel engine is generally apt to produce large combustion noise and an increased amount of NOx while it is operating in a low load and low speed region in the vicinity of an idling region, because this type engine depends upon self-ignition of fuel injected into the cylinders, which gives rise to a time lag between the fuel injection and the self-ignition of injected fuel. This time lag can be long particularly in the low load and low speed operating region of the engine wherein degraded fuel atomization impedes smooth vaporization of the injected fuel. As a reuslt, combustion of the injected fuel can take place at one time, causing large combustion noise and increased combustion temperature.

SUMMARY OF THE INVENTION

It is an object of the invention to provide a fuel injection system for multi-cylinder internal combustion engines, which is capable of effecting stable supply of fuel to the engine when it is operating in a low load and low speed region such as an idling region, to thereby achieve stable operation of the engine.

It is another object of the invention to provide a fuel injection system for multi-cylinder internal combustion engines, which is capable of reducing the combustion noise and the amount of NOx to be produced by the engine when it is operating in a low speed region in the vicinity of an idling region.

The present invention provides a fuel injection system for use with an internal combustion engine having a plurality of cylinders, comprising: a plurality of fuel injection valves mounted, respectively, in the cylinders; a plurality of fuel pressurizing means; a plurality of fuel passages each connecting a corresponding one of the fuel pressurizing means with a corresponding one of the fuel injection valves; a plurality of delivery valves arranged, respectively, across the fuel passages; a communication passage connecting at both ends thereof a first one of the fuel passages corresponding to one of the cylinders which is to be fired earlier, to a second one of the fuel passages corresponding to another one of the cylinders which is to be fired later, each at a location between one of the fuel injection valves and a corresponding one of the delivery valves associated with the first and second fuel passages; a selector valve arranged between the first fuel passage and the communication passage for selectively connecting one of the delivery valves across the first fuel passage with the fuel injection valve mounted in the one cylinder to be fired earlier, or with the communication passage; a one-way valve arranged across the communication passage for allowing fuel to flow in a sole direction from the first fuel passage to the second fuel passage; and a leak passage connecting the communication passage with a zone under a lower pressure at a location upstream of the one-way valve and having restriction means arranged therein for adjusting the amount of fuel flowing from the first fuel passage to the second fuel passage. When the engine is operating in a low load and low speed region in the vicinity of an idling region, injection of fuel into the one cylinder to be fired earlier is interrupted and a VIGOM injection into the other cylinder to be fired later is effected. The delivery valves each have an outlet port. The communication passage is connected at its both ends to the first and second fuel passages each at a location in the vicinity of the outlet port of a corresponding one of the delivery valves.

The above and other objects, features and advantages of the invention will be more apparent from the ensuing detailed description taken in conjunction with the accompanying drawings.

DETAILED DESCRIPTION

Figure 1:
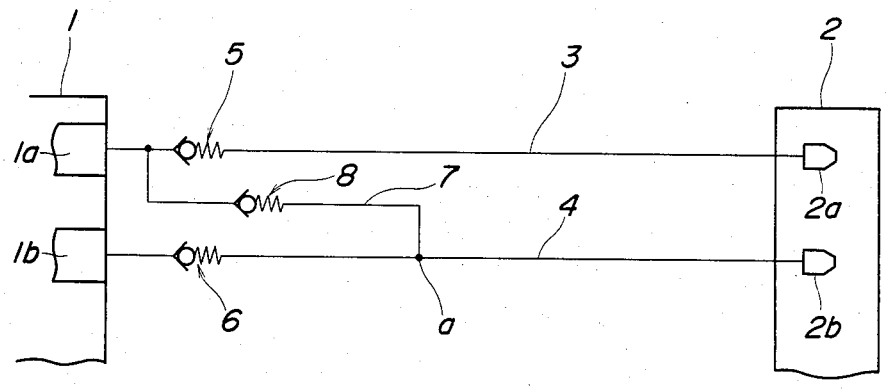
FIG. 1 PRIOR ART
FIG. 1 is a schematic view showing an example of a conventional fuel injection system.

Referring first to FIG. 1, there is illustrated a conventional fuel injection system for use with a multi-cylinder internal combustion engine, which has been proposed by Japanese Patent Publication No. 55-31310 and is adapted to effect a fuel injection in a small quantity into an engine cylinder in advance of a main injection, i.e. so-called VIGOM injection, so that fuel can be mixed well with air in the cylinder and burned easily at the following main injection, to thereby overcome the disadvantages that can occur in a low load and low speed operating region of the engine, such as large combustion noise. Fuel pressurizing chambers 1*a* and 1*b* of a fuel injection pump 1 are connected, respectively, with fuel injection valves 2*a* and 2*b* of a multi-cylinder internal combustion engine 2, via fuel passages 3 and 4. The fuel passage 3, which is connected to the fuel injection valve 2*a* mounted in an engine cylinder which is to be fired earlier, communicates at a location upstream of a delivery valve 5 arranged therein with the fuel passage 4 at a location downstream of a delivery valve 6 arranged therein, which is connected to the fuel injection valve 2*b* mounted in another engine cylinder which is to be fired later than the first-mentioned cylinder, via a communication passage 7. A one-way valve 8 is arranged across the communication passage 7 for allowing fuel to flow in a sole direction from the fuel passage 3 to the fuel passage 4, so that the fuel supplied to the fuel passage 3 corresponding to the first-mentioned cylinder is in part delivered to the fuel passage 4 corresponding to the second-mentioned cylinder, to effect a fuel injection in a small quantity through the fuel injection valve 2*b* in advance of a main injection, i.e. a VIGOM injection.

According to this conventional system, however, part of the fuel channel through which fuel flows for a VIGOM injection, that is, a portion of the communication passage 7 extending between the outlet port of the oneway valve 8 and the junction a thereof with the fuel passage 4, and a portion of the fuel passage 4 extending between the junction a and the outlet port of the delivery valve 6 are necessarily long and accordingly form a large dead volume while a VIGOM injection is effected through the fuel channel. As a reuslt, a correspondingly large quantity of fuel in the channel has to be compressed to such a pressure level as to realize a VIGOM injection, resulting in small and irregular or uneven VIGOM injection quantity. Therefore, the engine operation can still be unstable in a low load and low speed region in the vicinity of an idling region.

Figure 2:
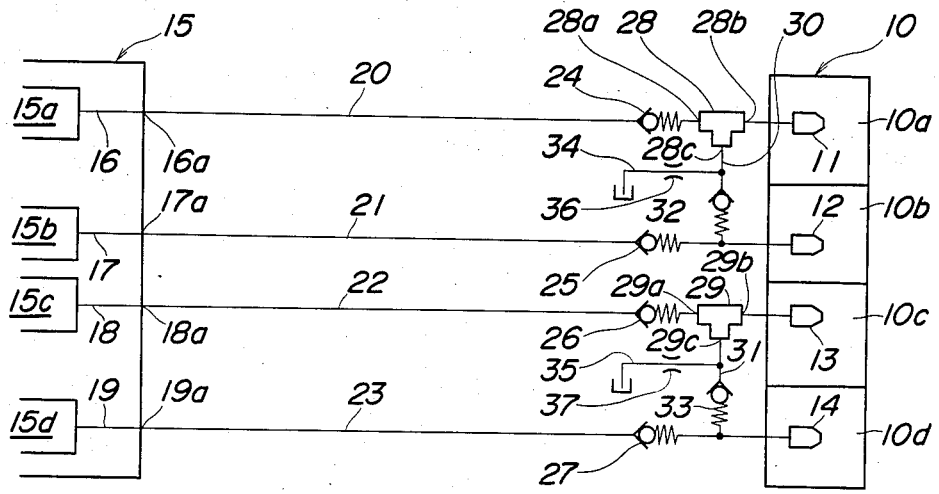
FIG. 2 is a view schematically illustrating a fuel injection system for multi-cylinder internal combustion engines, according to a first embodiment of the invention.

Referring now to FIG. 2, there is illustrated a fuel injection system according to the first embodiment of the invention, which is applied to a diesel engine 10 having four cylinders 10*a*–10*d* for instance, with fuel injection valves 11–14 mounted, respectively, in the cylinders 10*a*–10*d*. A fuel injection pump 15 is provided with fuel pressurizing means 15*a*–15*d* corresponding in number to the engine cylinders 10*a*–10*d*, for successively feeding pressurized fuel to fuel passages 16–19 in a predetermined sequence corresponding to the firing order of the cylinders 10*a*–10*d*. The fuel passages 16–19 have their outlet ports 16*a*–19*a* connected, respectively, to fuel injection valves 11–14 via fuel passages 20–23. Delivery valves 24–27, preferably each mounted in the housing or nozzle holder of a corresponding one of the fuel injection valves 11–14, are arranged across the respective fuel passages 20–23 at locations immediately upstream of the associated fuel injection valves 11–14. Selector valves 28 and 29 are arranged across the fuel passages connected to fuel injection valves corresponding to the engine cylinders to be fired earlier than respective other cylinders, for instance, the fuel passages 20, 22 corresponding to the cylinders 10*a*, 10*c*, respectively.

The selector valves 28, 29 have their inlet ports 28*a* and 29*a* connected, respectively, to the outlet ports of the delivery valves 24, 26, and their outlet ports 28*b* and 29*b* connected, respectively, to the fuel injection valves 11, 13. The other outlet ports 28*c* and 29*c* of the selector valves 28, 29 are connected via communication passages 30 and 31, respectively, to the fuel passages 21, 23 at locations immediately downstream of the associated delivery valves 25, 27, which are connected to the fuel injection valves 12, 14 mounted in the cylinders 10*b*, 10*d* which are to be fired later than the cylinders 10*a*, 10*c*, respectively. One-way valves 32 and 33 are arranged, respectively, across the communication passages 30, 31 for allowing fuel to flow in a sole direction from the outlet ports 28*c*, 29*c* of the selector valves 28, 29 to the fuel passages 21, 23. The distance between the outlet port of each of the one-way valves 32, 33 and the outlet port of a corresponding one of the delivery valves 5, 27 is set at the smallest possible value. That is, the one-way valves 32, 33 are each preferably mounted in the housing or nozzle holder of a corresponding one of the fuel injection valves 12, 14, so as to set the distance between each one-way valve 32, 33 and the delivery valve 25, 27 associated therewith, i.e. the fuel channel that forms a dead volume, at the smallest possible value.

Leak passages 34 and 35 are connected, respectively, to the communication passages 30, 31 at locations between the outlet ports 28*c*, 29*c* of the selector valves 28, 29 and the inlet ports of the one-way valves 32, 33. These leak passages 34, 35 allow part of the pressurized fuel to escape from the communication passages 30, 31 to a fuel passage under a lower pressure, to control a VIGOM injection quantity, hereinafter referred to, to a desired value. To this end, restriction means 36 and 37 are arranged in the leak passages 34, 35, respectively, for adjusting the amount of fuel to escape through the leak passages 34, 35.

The selector valves 28, 29, preferably each formed by an electromagnetic valve, are controlled by control signals supplied from a control unit, not shown, to selectively connect their inlet ports 28*a*, 29*a* to their one outlet ports 28*b*, 29*b* or to the other ones 28*c*, 29*c*. The control unit determines operating conditions of the engine 10 on the basis of signals supplied from an engine rotational speed sensor, an engine load sensor, etc., none of which is shown, and when it determines that the engine 10 is operating in a low load and low speed condition such as an idling condition, it causes the selector valves 28, 29 to shift to the positions wherein their inlet ports 28*a*, 29*a* are connected, respectively, to their one outlet ports 28*c*, 29*c*. When the engine 10 is determined to be in a condition other than the low load and low speed condition, the selector valves 28, 29 are shifted by the control unit so that their inlet ports 28*a*, 29*a* are connected to their other outlet ports 28*b*, 29*b*, respectively.

The fuel injection system constructed as above operates as follows: When the engine 10 is operating in a condition other than the low load and low speed condition, the control unit causes the inlet ports 28*a*, 29*a* of the selector valves 28, 29 to be connected to the outlet ports 28*b*, 29*b* of same, whereby the pressurized fuel supplied from the fuel injection pump 15 to the fuel passages 20–23 is delivered, respectively, via the delivery valves 24–27 to the fuel injection valves 11–14 to be injected therethrough into the cylinders 10*a*–10*d*. Since the delivery valves 24–27 are located in the vicinity of the respective fuel injection valves 11–14 as stated before, a secondary injection through the fuel injection valves 11–14 is restrained to a negligible level.

When the engine operation shifts to the low load and low speed condition such as an idling condition, the control unit causes shifting of the selector valves 28, 29 to the positions wherein their inlet ports 28*a*, 29*a* are connected, respectively, to the outlet ports 28*c*, 29*c*. Therefore, the fuel supply to the fuel injection valves 11, 13 is blocked, and the communication passages 30, 31 are connected to the fuel passages 20, 22, respectively, whereby the communication passages 30, 31 are supplied, via the selector valves 28, 29, with pressurized fuel that has been delivered to the fuel passages 20, 22 connected to the fuel injection valves 11, 13 corresponding to the cylinders 10*a*, 10*c* which are to be fired earlier than the cylinders 10*b*, 10*d*, respectively. The pressurized fuel supplied to each of the communication passages 30, 31 is in part drained via the leak passage 34, 35 to the fuel passage under a lower pressure, while the other part of the fuel is delivered via the one-way valve 32, 33 to the fuel passage 21, 23 connected to the fuel injection valve 12, 14 corresponding to the cylinder 10*b*, 10*d* which is to be fired later than the cylinder 10*a*, 10*c*, to thereby effect a VIGOM injection into the cylinder 10*b*, 10*d* through the fuel injection valve 12, 13. Thus, on this occasion, the fuel supply to the cylinders 10*a*, 10*c* is interrupted, and the engine 10 is operated with the other two cylinders 10*b*, 10*d* alone (partial cylinder operation).

After the fuel injection pump 15 has delivered pressurized fuel to the fuel passage 20 or 22, it supplies fuel with predetermined timing to the fuel passage 21 or 23, so that the fuel is delivered via the delivery valve 25, 27 to the fuel injection valve 10*b*, 10*d* to effect a main injection therethrough into the cylinder 10*b*, 10*d*.

As noted before, the distance of the fuel channel between the outlet port of each of the one-way valves 32, 33 and the outlet port of the delivery valve 25, 27 associated therewith is set at the smallest possible value, to thereby reduce the volume of the same channel as small as possible. Therefore, a small quantity of fuel in the small-volume fuel channel will be compressed to realize a VIGOM injection, and the reaction to the fuel compression is also small. Consequently, almost all of the fuel in each of the fuel passages 21, 23 supplied through the one-way valve 32, 33 is injected at one time as a VIGOM injection through the fuel injection valve 12, 14, whereby the VIGOM injection is effected in a perfect manner without time lag, secondary injection, or like irregularity.

If the idling speed of the engine 10 decreases due to the partial cylinder operation, a governor, not shown, of the fuel injection pump 15 operates to increase the quantity of fuel being supplied to the cylinders 10*b*, 10*d* which are then operating, to thereby maintain the engine speed at a required value. This increase of fuel supply to the cylinders 10*b*, 10*d* minimizes fluctuations in the fuel injection quantity, making the engine operation stable.

Figure 3:
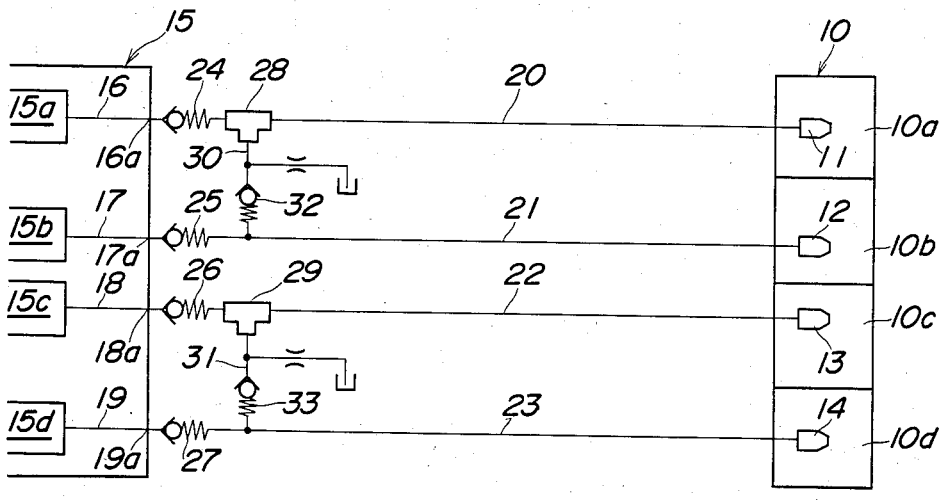
FIG. 3 is view schematically illustrating a fuel injection system according to a second embodiment of the invention.

FIG. 3 shows a second embodiment of the invention, which is applied to a fuel injection pump 15 of the type wherein delivery valves 24–27 are arranged, respectively, in the vicinity of outlet ports 16*a*–19*a* of fuel passages 16–19 in the fuel injection pump 15, typically, within the housing of the same pump 15. In FIG. 3, selector valves 28, 29, communication passages 30, 31, one-way valves 32, 33, leak passages 34, 35, and restriction means 36, 37, which are identical in construction and arrangement with corresponding ones in FIG. 1, are arranged in the passages 20–23 in the same manner as those in FIG. 1, but at locations as close as possible to the fuel injection pump 15. Like the first embodiment, the distance of the fuel channel between the outlet port of each of the one-way valves 32, 33 and the outlet port of the delivery valve 25, 27 associated therewith is set at the smallest possible value to reduce the volume of the same channel. According to the second embodiment of the invention, the component parts for effecting VIGOM injection are thus arranged in the vicinity of the fuel injection pump 15, the engine 10 is accordingly free from the weight of such component parts, and besides, the fuel injection system can easily be applied to existing fuel injection pumps, facilitating the manufacture of the fuel injection system.

Obviously many modifications and variations of the present invention are possible in the light of the above teachings. It is therefore to be understood that within the scope of the appended claims the invention may be practiced otherwise than as specifically described.

What is claimed is:

1. A fuel injection system for use with an internal combustion engine having a plurality of cylinders, comprising:

a plurality of fuel injections valves mounted, respectively, in said cylinders;

a plurality of fuel pressurizing means;

a plurality of fuel passages each connecting a corresponding one of said fuel pressurizing means with a corresponding one of said fuel injection valves;

a plurality of delivery valves arranged, respectively, across said fuel passages;

a communication passage connecting at both ends thereof a first one of said fuel passages corresponding to one of said cylinders which is to be fired earlier, to a second one of said fuel passages corresponding to another one of said cylinders which is to be fired later, each at a location between one of the fuel injection valves and a corresponding one of the delivery valves associated with said first and second fuel passages;

said delivery valves each having an outlet port, said communication passage being connected at said both ends thereof to said first and second fuel passages each at a location in the vicinity of said outlet port of a corresponding one of said delivery valves;

a selector valve arranged between said first fuel passage and said communication passage for selectively connecting one of said delivery valves across said first one fuel passage with said communication passage in a predetermined low load and low speed region of the engine, said selector valve connecting one of said delivery valves with a corresponding one of said fuel injection valves mounted in said one cylinder to be fired earlier in operating regions of the engine other than said predetermined low load and low speed region;

a one-way valve arrangd across said communication passage for allowing fuel to flow in only one direction from said first fuel passage to said second fuel passage; and a leak passage connecting said communication passage with a zone under a lower pressure at a location upstream of said one-way valve, said leak passage having restriction means arranged therein for adjusting the amount of fuel flowing from said first fuel passage to said second fuel passage.

2. A fuel injection system as claimed in claim 1, wherein said delivery valves are each located in the vicinity of a corresponding one of said fuel injection valves.

3. A fuel injection system as claimed in claim 1, wherein said delivery valves are each located in the vicinity of a corresponding one of said fuel pressurizing means.

* * * * *